US008866846B2

(12) United States Patent
Kim

(10) Patent No.: US 8,866,846 B2
(45) Date of Patent: Oct. 21, 2014

(54) APPARATUS AND METHOD FOR PLAYING MUSICAL INSTRUMENT USING AUGMENTED REALITY TECHNIQUE IN MOBILE TERMINAL

(75) Inventor: Ki-Yeung Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 30 days.

(21) Appl. No.: 13/173,062

(22) Filed: Jun. 30, 2011

(65) Prior Publication Data

US 2012/0007884 A1 Jan. 12, 2012

(30) Foreign Application Priority Data

Jul. 6, 2010 (KR) ..... 10-2010-0064654

(51) Int. Cl.

| | |
|---|---|
| ***G09G 5/00*** | (2006.01) |
| ***G10H 1/34*** | (2006.01) |
| ***G10H 1/24*** | (2006.01) |

(52) U.S. Cl.

CPC ..... *G10H 1/24* (2013.01); *G10H 2220/015* (2013.01); *G10H 2210/086* (2013.01); *G10H 2220/096* (2013.01); *G10H 2220/211* (2013.01); *G10H 2230/065* (2013.01); *G10H 2220/455* (2013.01); *G10H 2220/161* (2013.01); *G10H 2220/026* (2013.01); *G10H 2220/221* (2013.01); *G10H 2230/015* (2013.01); *G10H 1/34* (2013.01); *G10H 2220/005* (2013.01); *G10H 2230/045* (2013.01)

USPC ..... 345/633; 345/632; 345/629; 345/173

(58) Field of Classification Search

USPC ..... 345/629, 632–633, 173; 84/622, 650, 84/477 R; 381/118, 119; 463/35, 37; 438/201; 348/77; 382/187, 190, 181

See application file for complete search history.

(56) References Cited

U.S. PATENT DOCUMENTS

| | | | | |
|---|---|---|---|---|
| 6,995,310 | B1 * | 2/2006 | Knapp et al. | 84/722 |
| 2006/0045276 | A1 * | 3/2006 | Gamo | 381/17 |
| 2006/0084218 | A1 * | 4/2006 | Lee et al. | 438/201 |
| 2008/0260184 | A1 * | 10/2008 | Bailey et al. | 381/119 |
| 2009/0114079 | A1 * | 5/2009 | Egan | 84/477 R |
| 2009/0256801 | A1 * | 10/2009 | Helmer | 345/156 |
| 2010/0053105 | A1 * | 3/2010 | Choi | 345/173 |
| 2010/0178028 | A1 * | 7/2010 | Wahrhaftig et al. | 386/70 |
| 2011/0045907 | A1 * | 2/2011 | Villa et al. | 463/37 |
| 2011/0134061 | A1 * | 6/2011 | Lim | 345/173 |
| 2011/0316793 | A1 * | 12/2011 | Fushiki | 345/173 |
| 2012/0057012 | A1 * | 3/2012 | Sitrick et al. | 348/77 |
| 2012/0132057 | A1 * | 5/2012 | Kristensen | 84/650 |
| 2012/0174736 | A1 * | 7/2012 | Wang et al. | 84/622 |
| 2012/0304847 | A1 * | 12/2012 | Hacker | 463/35 |
| 2013/0133506 | A1 * | 5/2013 | Daisy | 84/455 |

* cited by examiner

*Primary Examiner* — Chante Harrison
(74) *Attorney, Agent, or Firm* — Cha & Reiter, LLC

(57) ABSTRACT

An apparatus and a method related to an application of a mobile terminal using an augmented reality technique capture an image of a musical instrument directly drawn/sketched by a user to recognize the particular relevant musical instrument, and provide an effect of playing the musical instrument on the recognized image as if a real instrument were being played. The apparatus preferably includes an image recognizer and a sound source processor. The image recognizer recognizes a musical instrument on an image through a camera. The sound source processor outputs the recognized musical instrument on the image on a display unit to use the same for a play, and matches the musical instrument play on the image to a musical instrument play output on the display unit.

18 Claims, 5 Drawing Sheets

APPARATUS AND METHOD FOR PLAYING MUSICAL INSTRUMENT USING AUGMENTED REALITY TECHNIQUE IN MOBILE TERMINAL

CLAIM OF PRIORITY

This application claims the benefit of priority under 35 U.S.C. §119(a) from a Korean patent application filed in the Korean Intellectual Property Office on Jul. 6, 2010 and assigned Serial No. 10-2010-0064654, the entire disclosure of which is hereby incorporated by reference in its entirety.

BACKGROUND OF THE INVENTION

1. Field of the Invention

The present invention relates to an apparatus and a method performing a function of a mobile terminal using an augmented reality technique. More particularly, the present invention relates to an apparatus and a method of a mobile terminal for capturing an image (i.e. visual representation) of a musical instrument directly drawn/sketched by a user to recognize the relevant musical instrument, and providing an effect of playing the musical instrument on the image as if a real instrument were played. The drawing can be on paper and scanned by the camera, or on the screen of a display, with, for example, a stylus or finger.

2. Description of the Related Art

Recently, a mobile terminal is rapidly distributed and used due to its convenience in portability and functionality. Therefore, service providers (terminal manufacturers) competitively develop the mobile terminal having even more convenient functions in order to secure more users.

For example, the mobile terminal provides functions far beyond the original purpose of voice communications, such as a phonebook, a game, a scheduler, a Short Message Service (SMS), a Multimedia Message Service (MMS), a Broadcast Message Service (BMS), an Internet service, an Electronic (E)-mail, a morning call and/or alarm feature, a Motion Picture Expert Group Audio Layer-3 (MP3) player, a digital camera, etc.

Recently, the games functions of a mobile terminal provide not only a simple entertainment but also reality and suspense.

In case of an action-packed game for example, a user may feel as if he/she became a main character or existed in the neighborhood through a showy graphic and realistic sounds. In addition, recently, games provide feeling as if the user directly played a musical instrument such as a piano, guitar, etc.

However, such games use graphical outputs and have a limitation in improving a sense of reality.

In more detail, in the case where a user plays a musical instrument such as a piano and a guitar through the mobile terminal, the user has to directly touch a display unit on which a graphic musical instrument is output, and display a location where the user's touch occurs to allow the user to recognize a note the user currently plays. However, since the user touches the display unit, which has a two dimensional surface, an effect of playing a real musical instrument cannot be obtained.

Therefore, to solve the above-described problem, there is a need in the art for an apparatus and a method for providing an additional service that has improved a better sense of reality in a mobile terminal than known heretofore.

SUMMARY OF THE INVENTION

An exemplary aspect of the present invention is to provide an apparatus and a method for providing a musical instrument playing function using an augmented reality technique in a mobile terminal.

Another exemplary aspect of the present invention is to provide an apparatus and a method for providing an effect of playing a real musical instrument on a mobile terminal by generating a sound source corresponding to a play through a musical instrument played on an image of the mobile terminal.

Still another exemplary aspect of the present invention is to provide an apparatus and a method for generating a score corresponding to a musical instrument virtually played on an image in a mobile terminal.

In accordance with an exemplary aspect of the present invention, an apparatus provides an effect of playing a musical instrument by using an augmented reality technique in a mobile terminal. The apparatus preferably includes an image recognizer for recognizing a musical instrument on an image through a camera, and a sound source processor for outputting the recognized musical instrument on the image on a display unit to use the same for a play, and matching the musical instrument play on the image to a musical instrument play output on the display unit.

In accordance with another exemplary aspect of the present invention, a method provides an effect of playing a musical instrument by using an augmented reality technique in a mobile terminal. The method preferably includes recognizing a musical instrument on an image through a camera, outputting the recognized musical instrument on the image and using the same for a play, and matching a musical instrument play on the image to a musical instrument play output on the display unit.

In accordance with still another exemplary aspect of the present invention, an apparatus for providing an effect of playing a musical instrument by using an augmented reality technique in a mobile terminal is provided. The apparatus preferably includes a camera for capturing an image and a user's hand motion, an image recognizer for recognizing a musical instrument on an image obtained through the camera, and recognizing a position of the user's hand motion input through the camera, a display unit for outputting the recognized musical instrument on the image, and a sound source processor for generating a sound source corresponding to the user's finger position when the user's finger position changes.

Other exemplary aspects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other exemplary aspects, features and advantages of certain exemplary embodiments of the present invention will become more apparent to a person of ordinary skill in the art from the following description taken in conjunction with the accompanying drawings in which.

Throughout the drawings, like reference numerals will be understood to refer to like parts, components and structures.

DETAILED DESCRIPTION

The following description with reference to the accompanying drawings is provided to assist a person of ordinary skill in the art with a comprehensive understanding of exemplary embodiments of the present invention as defined by the claims and their equivalents. The description includes various specific details to assist in that understanding but these are to be regarded as merely exemplary. Accordingly, a person of ordinary skill in the art will recognize that various changes and modifications of the exemplary embodiments described herein can be made without departing from the scope and spirit of the invention. Also, descriptions of well-known functions and constructions are omitted for clarity and conciseness.

Exemplary embodiments of the present invention provide an apparatus and a method for providing an effect of playing a musical instrument on an image in a mobile terminal as if a real musical instrument were played by using an augmented reality technique, and generating a score corresponding to the musical instrument played by the user.

Figure 1:
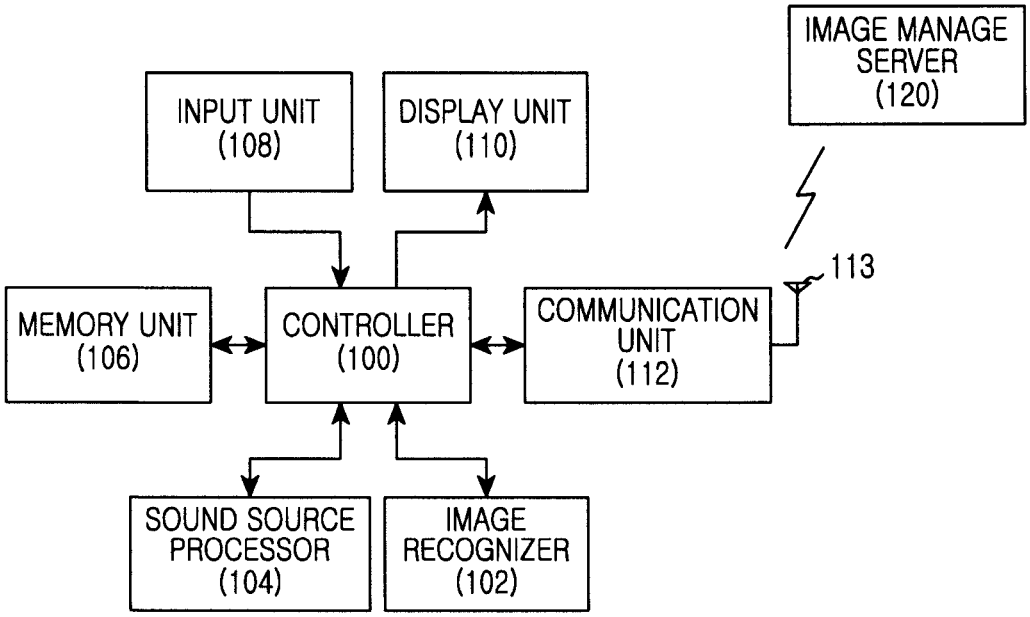
FIG. 1 is a block diagram illustrating a mobile terminal for enabling playing of a musical instrument by using an augmented reality technique according to an exemplary embodiment of the present invention.

FIG. 1 is a block diagram illustrating a mobile terminal that enables the effect of playing a musical instrument by using an augmented reality technique according to an exemplary embodiment of the present invention.

Referring now to FIG. 1, the mobile terminal may preferably include a controller 100, an image recognizer 102, a sound source processor 104, a memory unit 106, an input unit 108, a display unit 110, and a communication unit 112. The communication unit 112 may communicate with an image manage server 120. The mobile terminal may include additional units that are not illustrated here for sake of clarity. Similarly, the functionality of two or more of the above units may be integrated into a single component.

The controller 100 controls an overall operation of the mobile terminal. For example, the controller 100 performs processes and controls for voice communication and data communication. In addition to the general functions typical of a mobile terminal, according to an exemplary embodiment of the present invention, the controller 100 performs processes to recognize an image of a musical instrument a user desires to play and outputs an image of the recognized musical instrument to the display unit 110. In the case where the user performs (i.e. operates the function of) a "play" of a musical by using the image of the musical instrument on the display, the controller 100 processes to determine the user's finger position and output a sound source corresponding to the finger position.

In addition, the controller 100 processes to generate a score of a song the user has played using the user's finger position and the position of the changing finger. Thus, a user advantageously can write a song on the mobile phone just by playing the notes of an instrument that keeps a record of the notes using musical clefs. According to an exemplary embodiment of the present invention, the controller 100 may process the output of a display and the sound a musical instrument the user desires to play and a score of a song played by the user to the display unit 110 by using an augmented reality technique.

The image recognizer 102 recognizes a musical instrument the user desires to play through the image of a musical instrument and may include a camera for image capturing.

In other words, the image recognizer 102 recognizes the image of a musical instrument and the user's finger position through the camera and provides the same to the controller 100. At this point, the image recognizer 102 may determine a musical instrument the user desires to play by comparing a plurality of musical instrument information stored in the memory unit 106 with an image obtained through the camera, and may provide information regarding the image obtained through the camera to the image manage server 120 to receive information regarding a musical instrument the user desires to play.

The sound source processor 104 preferably matches the user's finger position recognized by the image recognizer 102 to a musical instrument output on the display unit 110 to output a sound source corresponding to the finger position under control of the controller 100.

In addition, the sound source processor 104 preferably processes the generation of a score of a song played by the user by using the user's finger position recognized by the image recognizer 102 under control of the controller 100. At this point, the sound source processor 104 may output the finger position and notes used for generating a score by using an augmented reality technique under control of the controller 100.

The memory unit 106 preferably includes non-transitory machine readable medium(s), such as Read Only Memory (ROM), Random Access Memory (RAM), a flash ROM, or other similar storage devices. The ROM stores microcodes of programs for processes and controls of the controller 100, the image recognizer 102, and the sound source processor, and various reference data.

The RAM preferably serves as a working memory of the controller 100 and stores temporary data that occur during execution of various programs. In addition, the flash ROM preferably stores various updatable data for storage such as a phonebook, calling messages, and received messages.

The input unit 108 preferably includes a plurality of function keys such as numerical key buttons of 0 to 9, a menu button, a cancel button, an OK button, a TALK button, an END button, an Internet access button, navigation key (directional key) buttons, letter input keys, etc., and provides key input data corresponding to a key pressed by a user to the controller 100. A person of ordinary skill in the art understands and appreciates that in the claimed invention the keys could be virtual and the input unit and the display unit may comprise a single touch screen.

The display unit 110 preferably displays status information generated during an operation of the mobile terminal, characters, moving images and still images, and the like. The display unit 110 may comprise a color Liquid Crystal Display (LCD), an Active Mode Organic Light Emitting Diode (AMOLED) display, and/or other types of thin-film technology screen display apparatuses. The display unit 110 may include a touch input device, and when it is applied to a touch input type mobile terminal, it can be used as an input unit.

The communication unit 112 transmits/receives a Radio Frequency (RF) signal of data input/output via an antenna 113. For example, during transmission, the communication unit 112, if using spread spectrum technology, channel-codes and spreads data to be transmitted, and then performs an RF process on the signal to transmit the signal. During reception, the communication unit 112 converts a received RF signal into a baseband signal, and despreads and channel-decodes the baseband signal to recover data. The communication unit 116 could also include a communication port for wired transfer, such as USB, and may also communicate in short-range protocols such as Bluetooth, etc. For example, time division and frequency division, are just a few examples of possible protocols. It is also to be appreciated by a person of ordinary skill in the art that the communication protocol is in no way limited to spread spectrum techniques.

In addition, the mobile terminal may include a microphone that can recognize a sound source occurring in the neighborhood (i.e. proximity, general area) of the device. The controller 100 may process to analyze a sound source input via the microphone and generate a score regarding the sound source occurring in the neighborhood of the device. The decision to process such a proximate sound can be based on, for example, a predetermined volume of the sound received by the microphone.

The functions of the image recognizer 102 and the sound source processor 104 may be performed by the controller 100 of the mobile terminal. The separate configuration and illustration of the image recognizer 102 and the sound source processor 104 are an exemplary purpose only for inconvenience in description, not for limiting the scope of the present invention. A person of ordinary skill in the art should appreciate that various modifications may be made within the scope of the present invention. For example, all of the functions of the image recognizer 102 and the sound source processor 104 may be processed by the controller 100.

Figure 2:
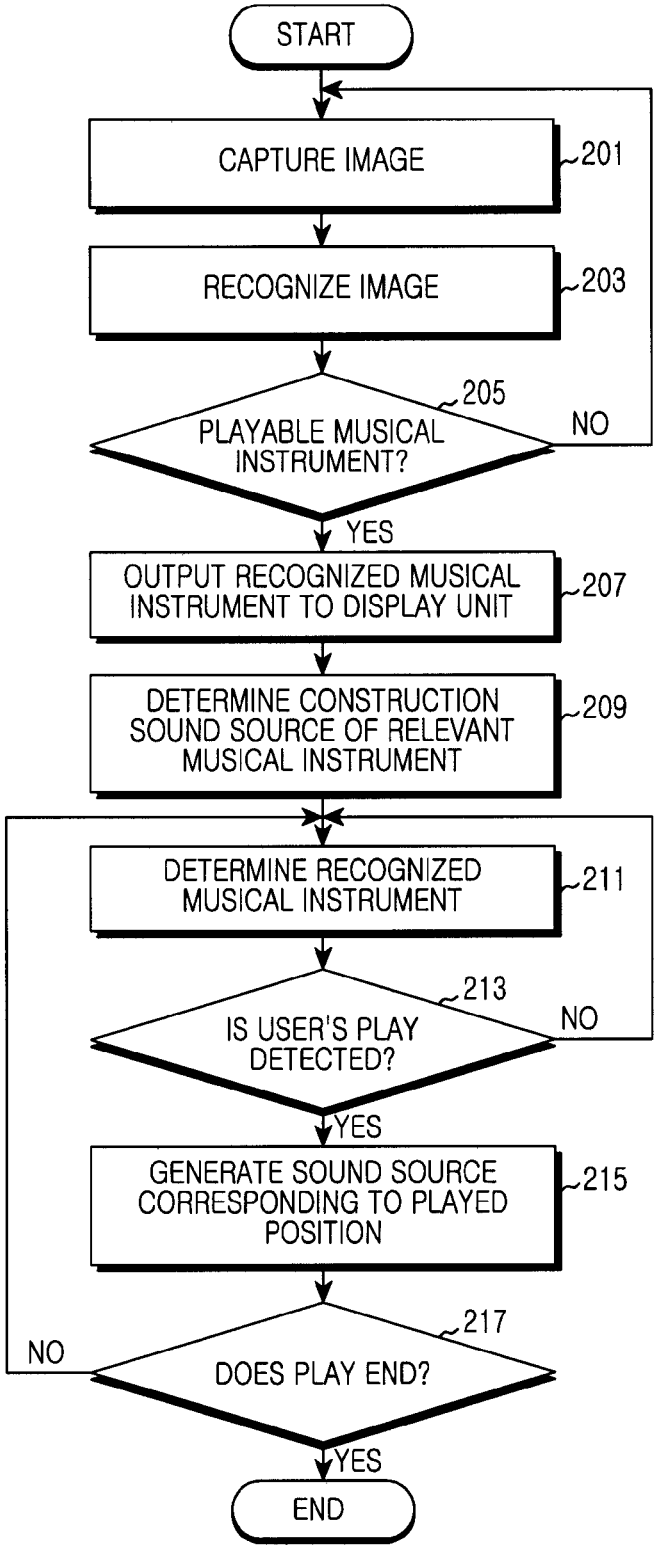
FIG. 2 is a flowchart illustrating a process for playing a musical instrument using an augmented reality technique in a mobile terminal according to an exemplary embodiment of the present invention.

FIG. 2 is a flowchart illustrating a process for playing a musical instrument using an augmented reality technique in a mobile terminal according to an exemplary embodiment of the present invention.

Referring now to FIG. 2, at step 2 the mobile terminal captures an image preferably using a camera, and at step 203 recognizes the captured image. Here, the image captured via the camera serves as an image of a musical instrument a user desires to play. The user may directly draw the musical instrument or a directly captured image of the musical instrument may be used as the image (for example a photo of a keyboard, or an actual piano). It is also possible for the user to draw the image on the screen utilizing a stylus, their finger, pointer, or device. Further the present invention can also incorporate voice recognition for certain terms. For example, after pressing a button, one can speak the word "piano" or "saxophone" or "alto saxophone", "harp" "tuba" etc., and the mobile terminal can utilize a lookup table to cross reference and identify the instrument, or this could be sent to a server or base station that could make the identification and provide back to the mobile terminal in real time.

At step 205, the mobile terminal determines whether a playable musical instrument has been recognized using the result of step 203. Here, the mobile terminal stores in advance information regarding playable musical instruments, and then may determine the playable musical instrument by determining whether information that matches the recognized image exists. Various types of image recognition technology could be used. In addition, the mobile terminal may transmit information of the image recognized in step 203 to a specific server that stores information regarding the musical instrument and receive information regarding the playable musical instrument from the server.

If the mobile terminal does not recognizing the playable musical instrument in step 205, the mobile terminal re-performs the process of step 201.

In contrast, when at step 205 the mobile terminal recognizes the playable musical instrument, then at step 207 the mobile terminal outputs an image of the musical instrument recognized using the image to a display unit. At this point, the mobile terminal may directly output the image captured in step 201 to the display unit, or changes the musical instrument corresponding to the image captured in step 201 into graphics and outputs the same to the display unit. Here, the changing of the musical instrument corresponding to the captured image into graphic and the outputting of the same are for increasing a visual effect by changing a musical instrument to be played into graphics like a real musical instrument.

At step 209, the mobile terminal determines a constituent sound source of the relevant musical instrument output on the display unit. Here, determining of the constituent sound source is preferably performed to determine all positions where notes may occur and sound sources corresponding to the positions in the output musical instrument. For example, in the case where the mobile terminal outputs keys on the display unit, the mobile terminal determines the positions of keys corresponding to, for example, an octave (the tones of a scale such as do, re, mi, fa, sol, la, ti, and do) of the output keys, and determines a sound source generated by a key/note pressed by a user by determining a sound source corresponding to each key position in advance.

At step 211, the mobile terminal determines whether the user plays the image recognized in step 203, that is, the recognized musical instrument. That is, the mobile terminal performs image capturing constantly to determine whether the user's finger is positioned at a position where a sound source may occur.

At step 213, the mobile terminal determines whether the user's playing of the instrument is detected.

When the mobile terminal does not detecting the user's play at step 213, the mobile terminal re-performs the process of step 211.

In contrast, when detecting the user's play at step 213, then at step 25 the mobile terminal determines a sound source corresponding to a position played by the user and generate the sound source. At this point, the user plays an image of the musical instrument drawn by the user or the musical instrument on the captured image. The mobile terminal determines the user's finger position using the camera and then generates a sound source of a musical instrument corresponding to the finger position. In addition, the mobile terminal may generate the sound source, and simultaneously, display the user's finger position (selected sound source) together with the musical instrument displayed on the display unit. That is, the mobile terminal may output the musical instrument drawn by the user and then output a symbol representing a sound source selected by the user's finger using the augmented reality technique. The image of the finger could be real or virtual.

At step 217, the mobile terminal determines whether or not the play by the user has ended.

When the mobile terminal determines at step 217 that the user has not stop playing, the mobile terminal re-performs the process of step 211.

In contrast, when the mobile terminal determines at step 217 that the user has stop playing, the mobile terminal ends the present process.

Figure 3:
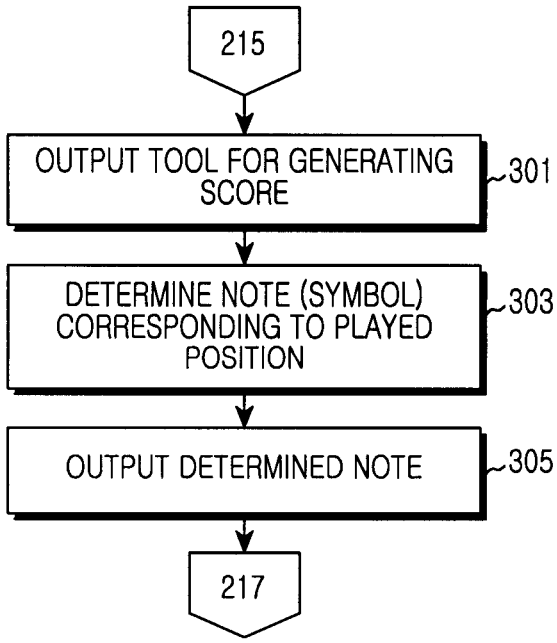
FIG. 3 is a flowchart illustrating a process for generating a score corresponding to a musical instrument play in a mobile terminal according to an exemplary embodiment of the present invention.

FIG. 3 is a flowchart illustrating a process for generating a score corresponding to a musical instrument play in a mobile terminal according to an exemplary embodiment of the present invention.

Referring now to FIG. 3, the mobile terminal determines and generates a sound source corresponding to a position played by a user as in step 215 of FIG. 2.

To generate a score corresponding to a musical instrument play by a user, the mobile terminal outputs a tool for generating a score in step 301. Here, the tool for generating the score may include display of a manuscript on which a note played by a user can be represented, for example, a treble clef or a base clef with the lines forming a staff. However, the generation of the score is not limited to the generation and display of the score to standard musical language, and can be provided in a different format(s).

At step 303, the mobile terminal determines the user's finger position using a camera and then determines a note corresponding to the position played by the user by determining a note corresponding to the finger position.

At step 305, the mobile terminal outputs the note determined in step 303 to the tool for generating a score. For example, in the case where a user of the mobile terminal positions his finger at a position 'do' of a key on an image, the mobile terminal may generate a sound source corresponding to 'do' and generate a score by outputting a note at a position 'do' of the output tool as described above.

Referring now to FIG. 2, the mobile terminal at step 217 determines whether a play by the user has ended.

At this point, the mobile terminal may output a tool for generating a score, and then output a note corresponding to the user's finger position using the augmented reality technique.

FIG. 4 are views illustrating a process for playing a musical instrument using the augmented reality technique in a mobile terminal according to an exemplary embodiment of the present invention.

Figure 4A:
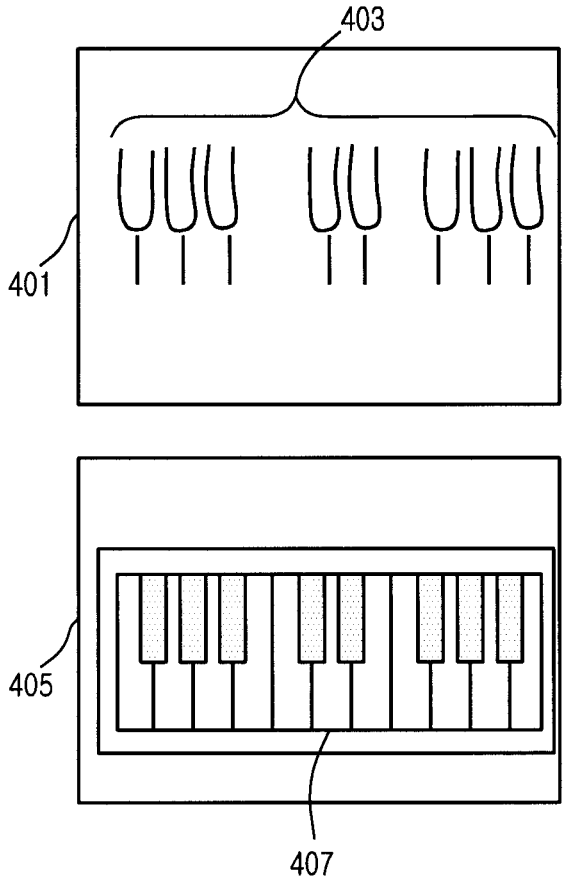
FIG. 4A is a view illustrating a process for recognizing a musical instrument a user desires to play in a mobile terminal according to an exemplary embodiment of the present invention.

FIG. 4A is a view illustrating a process for recognizing a musical instrument a user desires to play in a mobile terminal according to an exemplary embodiment of the present invention.

Referring to FIG. 4A, the user of the mobile terminal directly draws a musical instrument 403 the user desires to play on a paper 401, or prepares a paper on which the musical instrument is printed. Alternatively, the user could draw the instrument on the screen using a stylus or their finger. The paper could also be a previous photograph of an instrument. Image detection/recognition techniques can be used to identify the image drawn with images of instruments stored in memory that could use, for example, feature points, and thresholds of comparisons for the processor to determine the desired instrument. This operation could occur in the mobile terminal or in, for example, the image manage server.

The mobile terminal recognizes the musical instrument the user desires to play by capturing an image on which the musical instrument has been output using a camera, and outputs the recognized musical instrument 407 on a preview screen 405.

At this point, the mobile terminal may directly output the musical instrument 403 existing on the paper on the preview screen 405, or increase the user's visual effect by outputting graphics corresponding to the musical instrument.

Figure 4B:
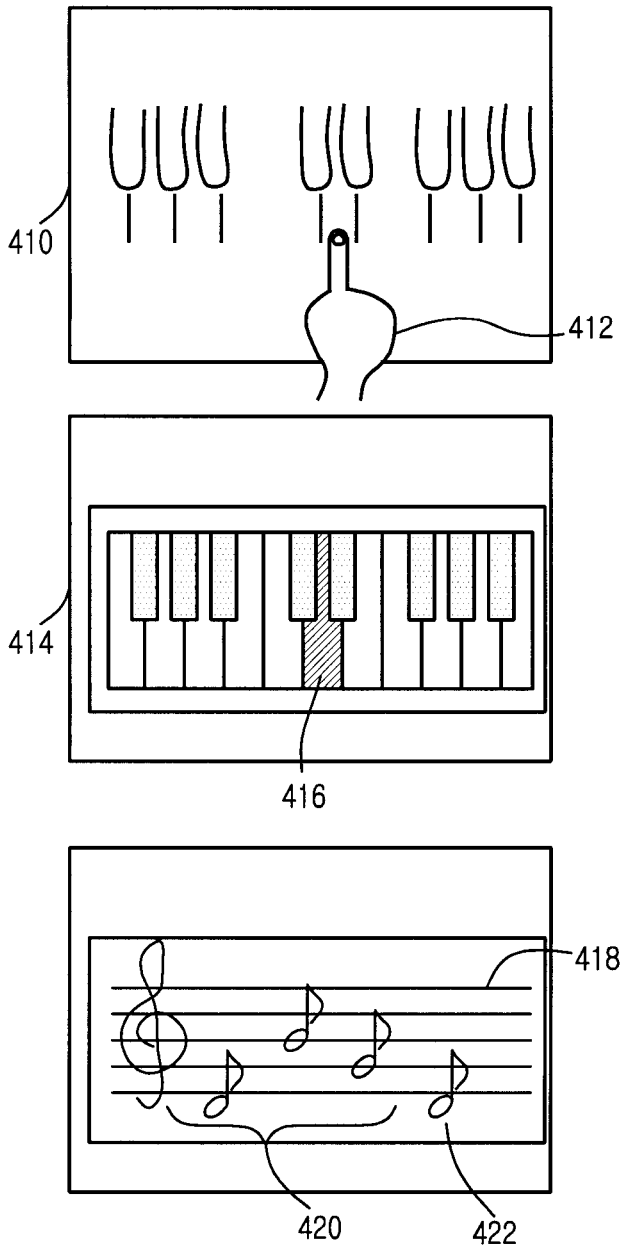
FIG. 4B is a view illustrating a process for recognizing a user's play in a mobile terminal according to an exemplary embodiment of the present invention.

FIG. 4B is a view illustrating a process for recognizing a user's play in a mobile terminal according to an exemplary embodiment of the present invention.

Referring now to FIG. 4B, in the case where the mobile terminal recognizes a musical instrument a user desires to play as in FIG. 4A, the mobile terminal preferably determines a constituent sound source of the recognized musical instrument, and then determines the user's finger position by capturing an image on which the musical instrument has been drawn by using a camera.

In the case where the user of the mobile terminal positions (plays) (412) his finger at a 'D' position of the musical instrument on the paper 410, the mobile terminal outputs a sound source (in this case a note corresponding to the note "D" on a keyboard) corresponding to the user's finger position. At this point, the mobile terminal allows the user to recognize the currently played key by outputting the sound source and simultaneously shading (416) a position 'D' of a graphic key output on a preview screen 414.

Also, the mobile terminal generates a sound source corresponding to the user's finger position and then generates a score of a song played by the user using notes of keys corresponding to the finger positions as described above. The drawing shown in FIG. 4B illustrates that 'D' corresponding to the user's current finger position is output (422) on a score 418 (manuscript paper). The note 'D' is output (420) together with notes previously played by the user to form one score. The shown score illustrates a score corresponding to the user's play who has pressed keys of 'D', 'G', and 'D'. The sound emitted could be, for example, referenced in memory from a lookup table, etc. At this point, the mobile terminal may output a musical instrument the user desires to play, a key position of a graphic musical instrument corresponding to the user's finger position, and a note for generating a score on the display unit using the augmented reality technique.

According to an exemplary embodiment of the present invention, the mobile terminal may recognize music reproduced in the neighborhood (i.e. proximity, general area) of the device or the mobile terminal may analyze sound sources of reproduced music. For example, in the case where the mobile terminal reproduces a children's song titled 'school bell', the mobile terminal may analyze sound sources (for example, sol, sol, la, la, sol, sol, mi, . . . (syllable names of the children's song) forming the reproduced children's song. After that, the mobile terminal may perform a score generating process by mapping the analyzed sound source to a tool for generating the score using the augmented reality technique.

The above-described methods according to the present invention can be implemented in hardware, firmware or as software or computer code that can be stored in a recording medium such as a CD ROM, an RAM, a floppy disk, a hard disk, or a magneto-optical disk or downloaded over a network and stored on a non-transitory machine readable medium, so that the methods described herein can be rendered in such software using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

As described above, exemplary embodiments of the present invention provide an apparatus and a method for providing a musical instrument play function using the augmented reality technique in a mobile terminal. Exemplary embodiments of the present invention may recognize a musical instrument play on an image to provide an effect of playing a real musical instrument, and generate a score of a song corresponding to the musical instrument play to improve a sense of reality related to the musical instrument play.

Although the invention has been shown and described with reference to certain exemplary embodiments thereof, it will be understood by those skilled in the art that various changes in form and details may be made therein without departing from the spirit and scope of the invention as defined by the appended claims and their equivalents. Therefore, the scope of the present invention should not be limited to the above-described embodiments but should be determined by not only the appended claims but also the equivalents thereof.

What is claimed is:

1. An apparatus for identifying and providing a virtual musical instrument for play, the apparatus comprising:

a camera;

a display unit;

an image recognizer that receives a visual representation of a musical instrument, processes the visual representation using an image recognition technique to recognize the musical instrument, and detects whether the recognized musical instrument is one of a plurality of virtual musical instruments that the apparatus is capable of providing; and a sound source processor that outputs the visual representation of the musical instrument to the display unit for using the visual representation of the musical instrument for a virtual play of the musical instrument, and provides audible output of notes corresponding to touched positions in the visual representation of the musical instrument;

wherein the visual representation of the musical instrument is captured by the camera.

2. The apparatus of claim 1, wherein the sound source processor generates a score corresponding to the virtual play of the musical instrument.

3. The apparatus of claim 1, wherein the sound source processor uses an augmented reality technique to perform the virtual play of the musical instrument, and generates a score corresponding to the virtual play of the musical instrument.

4. The apparatus of claim 3, where the score comprises musical notes corresponding to the virtual play of the musical instrument.

5. The apparatus of claim 1, wherein the sound source processor uses the camera to identify one or more positions in the visual representation of the musical instrument that are touched, and outputs sound corresponding to the one or more positions that are touched.

6. The apparatus of claim 5, wherein the sound source processor generates a sound source corresponding to the one or more positions that are touched.

7. The apparatus of claim 1 wherein:

when it is the detected that the recognized musical instrument is one of the plurality of musical instruments that the mobile terminal is capable of providing, the sound source processor generates a mapping of locations in the visual representation of the musical instrument to notes, and the audible output of notes is provided in accordance with the generated sound source.

8. An apparatus for identifying and providing a virtual musical instrument for play using an augmented reality technique in a mobile terminal, the apparatus comprising:

a display unit;

an image recognizer that recognizes a visual representation of a musical instrument; and a sound source processor that outputs the recognized visual representation of the musical instrument to the display unit for using the visual representation for virtual play, and provides audible output of notes matching touched positions of the image of the musical instrument output on the display unit, wherein the visual representation recognized by the image recognizer is a hand drawing of an instrument.

9. An apparatus for identifying and providing a virtual musical instrument for play using an augmented reality technique in a mobile terminal, the apparatus comprising:

a display unit;

an image recognizer that recognizes a visual representation of a musical instrument; and a sound source processor that outputs the recognized visual representation of the musical instrument to the display unit for using the visual representation for virtual play, and provides audible output of notes matching touched positions of the image of the musical instrument output on the display unit, wherein the visual representation is made with a stylus or finger and recognized by the image recognizer.

10. A method for providing a musical instrument for virtual play using an augmented reality technique, the method comprising:

capturing, by using a camera, a visual representation of the musical instrument;

processing the visual representation, by using an image recognition technique, to recognize the musical instrument and detect whether the recognized musical instrument is one of a plurality of virtual musical instruments that the mobile terminal is capable of providing;

outputting, by a processor, the visual representation of the musical instrument for display on a display unit and for a virtual play of the recognized musical instrument when it is detected that the recognized musical instrument is one of the plurality of virtual musical instruments that the mobile terminal is capable of providing; and matching user manipulation of the musical instrument while being virtually played to the visual representation of the musical instrument displayed by the display unit.

11. The method according to claim 10, further comprising generating a mapping of locations in the visual representation of the musical instrument to notes when it is the detected that the recognized musical instrument is one of the plurality of virtual musical instruments that the mobile terminal is capable of providing.

12. The method of claim 10, further comprising, generating a score corresponding to the virtual play of the recognized musical instrument.

13. The method of claim 12, wherein the matching of the user manipulation of the musical instrument and the generating of the score are performed by using at least one augmented reality technique.

14. An apparatus for providing a musical play using an augmented reality technique in a mobile terminal, the apparatus comprising:

a camera for capturing an image of a musical instrument;

a controller for:

receiving the image from the camera, processing the image by using an image recognition technique for recognizing the musical instrument, detecting whether the recognized musical instrument is one of a plurality of musical instruments that the mobile terminal is capable of providing, when the musical instrument is one of the plurality of musical instruments the mobile terminal is capable of providing, generating a sound source based on the received image;

recognizing through additional images of the musical instrument captured by the camera a position of a hand motion, and audibly outputting a sound based on the sound source and the position of the hand motion;

wherein the sound source includes a mapping of locations in the image received from the camera to different sounds.

15. The apparatus of claim 14, wherein the controller is further for generating a score based on the hand motion.

16. The apparatus of claim 14, further comprising:

a microphone for receiving a sound input; and wherein the controller is further for analyzing the sound input to generate a score.

17. An method for providing a musical play comprising:

capturing, by a camera, an image of a musical instrument;

processing, by a controller, the image via an image recognition technique to identify the musical instrument;

detecting whether the identified musical instrument is a musical instruments that the mobile terminal is capable of providing;

when the identified musical instrument is a musical instruments that the mobile terminal is capable of providing, generating a sound source for the identified musical instrument based on the image;

capturing additional images of the musical instrument by the camera;

processing the additional images to identify a position of a hand motion that is recorded in the additional images; and generating a sound based on the position of the hand motion and the sound source;

wherein the sound source includes a mapping of locations in the image captured by the camera to different sounds.

18. A method for identifying and providing a virtual musical instrument for play, the method comprising:

receiving, by a touchscreen of an electronic device, an input that draws a visual representation of a musical instrument on the touchscreen; and displaying the visual representation of the musical instrument on the touchscreen for using the visual representation of the musical instrument for virtual play;

receiving, by the touchscreen, input at a position in the visual representation of the musical instrument; and audibly outputting a musical note corresponding to the position in the visual representation of the musical instrument where the input is received.

* * * * *